United States Patent [19]

Schoell

[11] 4,193,370

[45] Mar. 18, 1980

[54] PLANING BOAT HULL

[76] Inventor: Harry L. Schoell, Miami, Fla.

[21] Appl. No.: 940,933

[22] Filed: Sep. 8, 1978

Related U.S. Application Data

[63] Continuation of Ser. No. 779,752, Mar. 21, 1977, abandoned.

[51] Int. Cl.[2] ..... B63B 1/18

[52] U.S. Cl. ..... 114/291; 114/56

[58] Field of Search ..... 114/56, 271, 291; 9/6 P, 6 M; D12/62

[56] References Cited

U.S. PATENT DOCUMENTS

| | | | |
|---|---|---|---|
| D. 234,685 | 4/1975 | Cole | D12/62 |
| 3,045,629 | 7/1962 | Farrington | 114/56 |
| 3,303,809 | 2/1967 | Ross | 114/56 |
| 3,602,179 | 8/1971 | Cole | D12/62 X |
| 3,802,370 | 4/1974 | Collier | 114/271 |
| 3,808,999 | 5/1974 | Peterson | 114/56 X |

*Primary Examiner*—Sherman D. Basinger

[57] ABSTRACT

A planing boat hull having a conical contour extending from the bow portion to the stern for a distance equal to substantially one-third the length of the hull at the keel and two-thirds or more at the chine, the after section of the hull consisting of a flat surface on each side of the keel maintaining a constant dead rise angle of 12 to 18 degrees extending to the wide lipped chine, and a chine lip portion extending at the same angle as the dead rise but in a reverse direction.

1 Claim, 5 Drawing Figures

10
11
K
VP
17
X
P
90°
HP
A
C
16
4
5
Y
D
13
12

15
A
M
A
16
21
20
D
D
20
14

PLANING BOAT HULL

This application is a continuation of application Ser. No. 779,752, filed Mar. 21, 1977, and now abandoned.

BACKGROUND OF THE INVENTION

1. Field of the Invention

This invention relates to hull structures for boats and is more particularly directed to a planing boat hull.

2. Description of the Prior Art

The present planing boat hulls are of the V-type construction. These hulls have an arcuate contour extending on either side of the keel from the bow to the stern which effect good riding characteristics to the boat when planing, when moving in the direction of a head or following sea and at a speed for which the hull is designed. When a planing boat having a conventional V-hull is not planing or when moving along a quartering sea, its lateral stability is very poor and high impacts of the hull are experienced as the speed of the planing hull is increased. Also, the bow of the boat tends to ride at an increasing angle thereby increasing the impacts of the hull. Since the water flowing past the boat follows the shape of the hull, the spray created by the forwardly moving boat tends to spray in the direction of the occupants of the boat. The present invention intends to avoid the above indicated poor characteristics of the conventional V-type hulls for planing boats by providing a hull that is partially arcuate and partially flat whose stern is provided with an appropriate dead rise and chines extending about the outer edges of the hull of substantially equal but oppositely extending angle as the dead rise.

SUMMARY OF THE INVENTION

Therefore, a principal object of the present invention is to provide a hull for a planing boat whose contour is partially arcuate, namely the surface of a cone, and partially flat thereby increasing its lateral stability at non-planing speeds.

Another object of the present invention is to provide a hull of a planing boat with a conical surface extending from the bow on each side of the keel to a position approximately one-third the length of the boat and flat surfaces extending to the stern on each side of the keel for the remainder of the hull.

A further object of the present invention is to provide a dead rise at the stern of the boat of approximately 12° to 18° with chines on each side of the hull extending from the stern to the bow whose total width is equal to approximately 20 percent of the total width of the hull.

A still further object of the present invention is to provide a hull of a planing boat having a relatively low hull impact at planing speeds in a quartering head or following sea, excellent lateral stability at low and planing speeds, relatively low hull impact at high planing speeds and whose spray is directed away from the hull so as not to wet the occupants of the boat while planing.

With these and other object in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFERRED EMBODIMENT

Figures 1, 2:
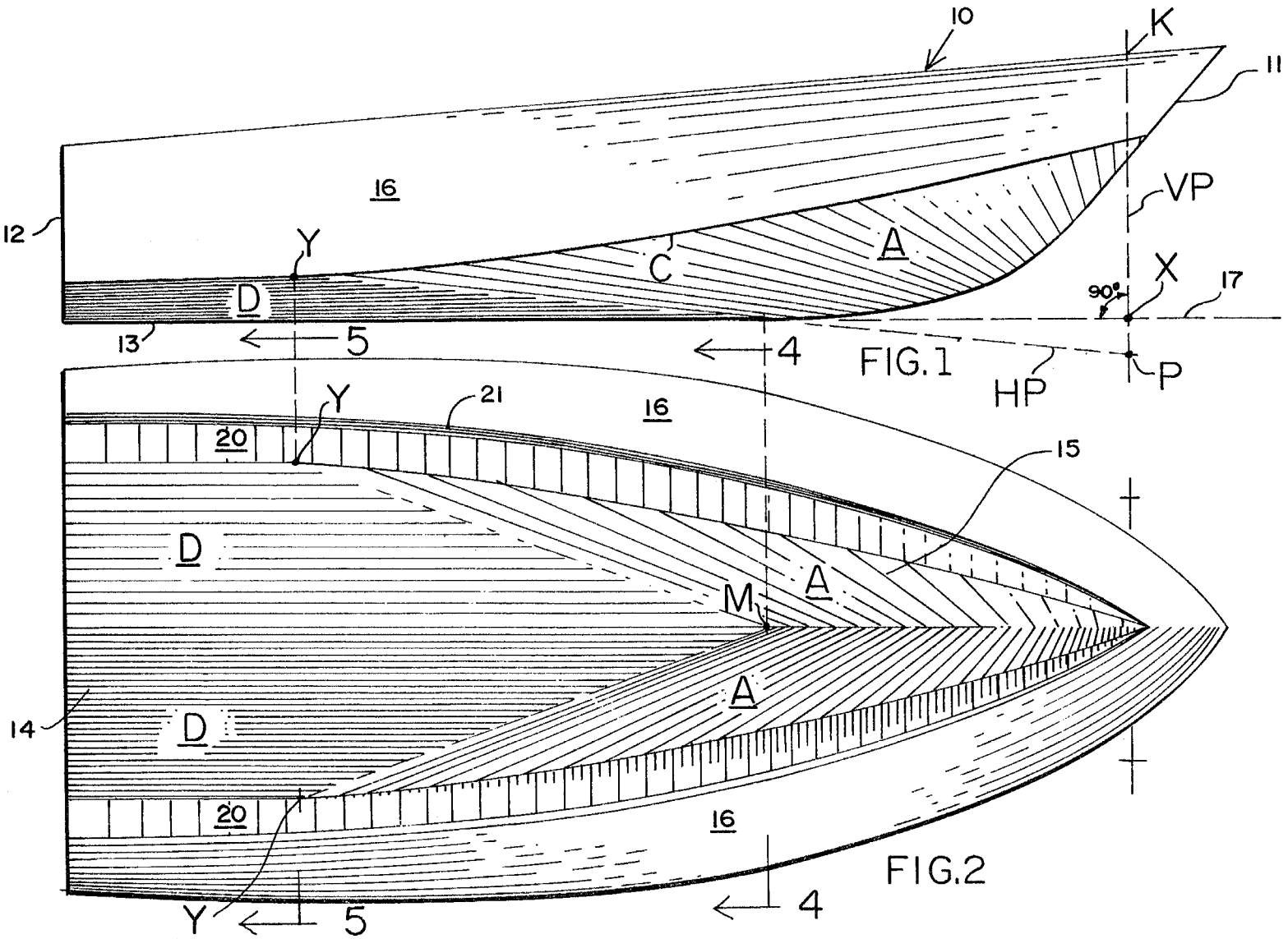
FIG. 1 is a side elevational view of a boat hull constructed in accordance with my invention.
FIG. 2 is a bottom plan view.
Figure 3:
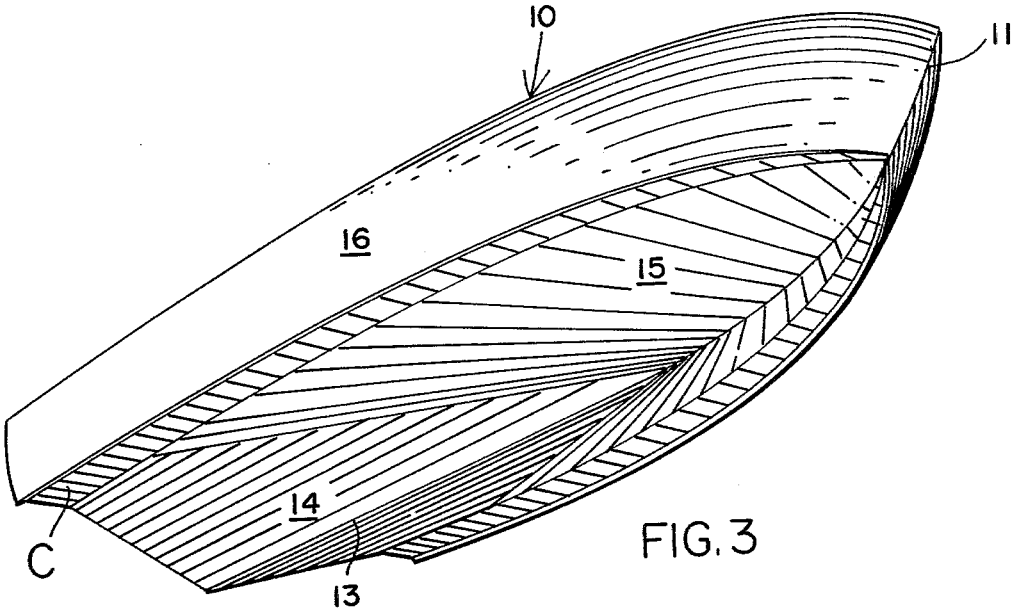
FIG. 3 is a perspective view.
Figure 4:
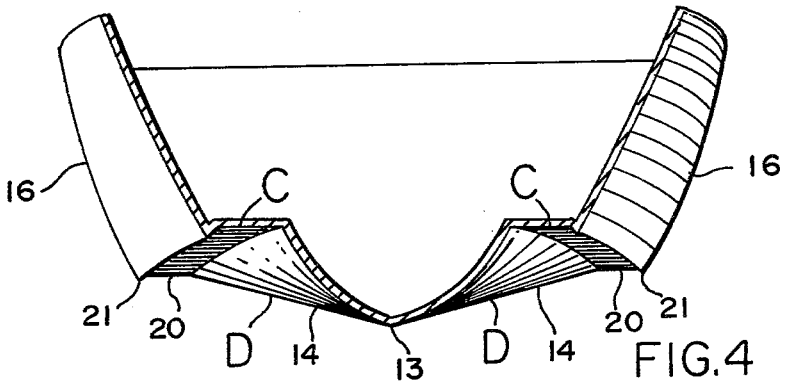
FIGS. 4 and 5 are cross sectional views taken along the lines 4—4 and 5—5 respectively of FIG. 2.
Figure 5:
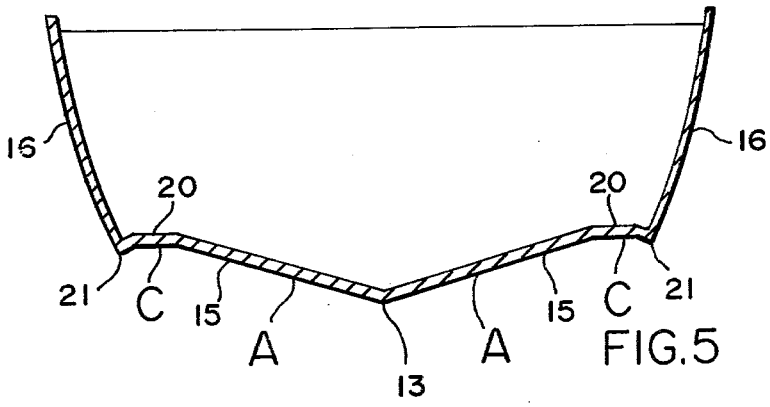

Referring to the drawings wherein like numerals are used to designate similar parts throughout the several views, the numeral 10 refers to a hull of a planing boat constructed in accordance with my invention and consisting generally of a bow portion 11, stern portion 12, a keel 13 extending from the bow portion 11 to the stern portion 12, substantially flat and coplanar bottom hull portions 13 and 14 symmetrically disposed on each side of the keel 13 extending upwardly to a chine portion—C—whose outer edge portion on each side of the boat 10 joins a side hull portion 16 that likewise extends from the bow portion 11 to the stern portion 12.

Optimum results have been attained from my boat 10 during planing and non-planing speeds wherein the width or beam of the boat 10 is approximately ⅓ of the length of the boat 10 and the deadrise, which is the angle formed by the bottom hull 14 with the horizontal is between 12 degrees and 18 degrees. The keel 13 extends from the stern portion 12 in a horizontal position up to a position—M—which is approximately two-thirds the length of the boat 10, then the keel 13 extends upwardly as best shown by FIG. 1.

The bottom hull portion 14 which consists of symmetrically disposed flat planes extending from the keel 13 to the chine portions—C—and to the rear edge portion of the bottom arcuate hull portion 15. The botton hull portion 14 known as the delta area—D—contacts the water during the planing of the boat 10 to provide the boat 10 with a minimum of water resistence and good stability. The bottom hull portion 14 or delta area—D—engages the chine portions—C—at the stern portion 12 and extends forwardly for a distance less than one-third of the length of the boat 10 as at—Y—where the delta area—D—engages the bottom hull portion 15 to position—M—. The botton hull surface 15 is arcuate, namely the curved surface of a cone and called the conic area—A—. The apex of the cone whose surface the conic area —A—is a segment of is determined as follows: a vertical plane —VP—positioned rearwardly of the bow 11 a distance of approximately one-tenth the length of the boat 10 as at—K—, intersects at right angle a horizontal plane passing through the keel 13 indicated as at—X—in FIG. 1 and is extended a slight distance therebeyond. A second plane—HP—extends between the positions—Y—of the chine portions and position —M—and intersects the plane—VP—at position—P—the center of which is the apex of a cone forming the arcuate surfaces of the conic area—A—. The conic area—A—is in contact with the water only when the boat 10 is at less than planing speeds or when engaged by waves.

The chine portions—C—are of constant width throughout the length of the boat except at the bow 11 where they taper or converge together as best shown by FIG. 2.

The total chine width is approximately equal to one-fifth the width of the hull 14, 15 at the beam. The chine portions—C—extend from the outer edges of the bottom hulls 14 and 15 in a horizontal portion 20 joined at their edge portions by a downwardly inclined chine lip portion 21 extending at the same angle as the dead rise, namely 12 to 18 degrees but in a reverse direction. The chine lip portion 21 forms the bottom edge of the side hull walls 16. The wide chines —C—assists in dampening the lateral roll of the boat 10 when at rest and also directs spray away from the boat when the boat 10 is underway. The reversely directed chine lip portion with its 12°-18° reverse angle tends to direct the water slightly inwardly in a manner so as not to interfere with the optimum performance of the hull and yet tends to keep the water from riding over the chine area and up the sides of the hull. However, when the boat 10 is planing, the chines—C—will be sufficiently out of the water so that they cannot impact, but will limit the lean entry into a wave, so as not to bury up too far into the wave which otherwise would cause the boat 10 to broach. The roundness of the conical area 15 also cushions the riding characteristics of boat 10.

What I claim as new and desire to secure by Letters Patent is:

1. In a planing boat hull having a bow portion, a stern portion, an upper hull portion, a lower hull portion and a keel extending between said bow portion and said stern portion, a chine portion joining said upper hull portion and said lower hull portion and extending the length of said hull, said lower hull portion having an arcuate portion at the bow formed from a segment of a cone extending on either side of said keel from said bow portion and toward said stern portion and a substantially flat and coplanar portion extending upwardly from 12° to 18° from the horizontal on either side of said keel from said arcuate portion to said stern portion, said keel lying substantially horizontally from said stern portion to substantially two-thirds of the length of said boat hull, said flat portion of said lower hull portion bordering on said horizontal portion of said keel and the remainder of said keel extending along said arcuate portion of said lower hull portion, said chine portions each having a substantially horizontal portion extending outwardly from the edges of said lower hull portion and a chine lip portion extending the length of the chine portions and extending downwardly from said horizontal portion and in a reverse direction from said flat portion of said lower hull portion at substantially 12 to 18 degrees from the horizontal.

* * * * *